US006415940B1

(12) United States Patent
Brabson, II

(10) Patent No.: US 6,415,940 B1
(45) Date of Patent: Jul. 9, 2002

(54) COMPARTMENTED CONTAINER

(75) Inventor: Hobert W. Brabson, II, 3503 Crestwood Dr., Cleveland, TN (US) 37312

(73) Assignee: Hobert W. Brabson, II, Cleveland, TN (US)

( * ) Notice: Subject to any disclaimer, the term of this patent is extended or adjusted under 35 U.S.C. 154(b) by 0 days.

(21) Appl. No.: 09/564,569

(22) Filed: May 5, 2000

Related U.S. Application Data

(63) Continuation of application No. PCT/US99/03569, filed on Feb. 22, 1999.
(60) Provisional application No. 60/113,251, filed on Dec. 21, 1998.

(51) Int. Cl.[7] ..... B65D 25/04
(52) U.S. Cl. ..... 220/505; 220/639
(58) Field of Search ..... 220/505, 503, 220/551, 556, 639

(56) References Cited

U.S. PATENT DOCUMENTS

| | | | |
|---|---|---|---|
| 239,225 A | 3/1881 | Claussen | |
| 853,497 A | 5/1907 | Carnes | |
| 861,815 A | 7/1907 | Cullen | |
| 1,013,775 A | 1/1912 | Hoffman | |
| 1,942,953 A | 1/1934 | Bennett | |
| 2,553,559 A | 5/1951 | Eckman | |
| 2,652,148 A | 9/1953 | Pfeifer | |
| 2,963,194 A | 12/1960 | Brennan et al. | |
| 5,279,841 A | 1/1994 | Yu | |

FOREIGN PATENT DOCUMENTS

| | | | | |
|---|---|---|---|---|
| FR | 1071351 | * | 5/1954 | ..... 220/524 |
| GB | 692439 | | 6/1953 | |
| GB | 946802 | | 1/1964 | |
| JP | 4-031237 | | 2/1992 | |

* cited by examiner

*Primary Examiner*—Joseph M. Moy

(57) ABSTRACT

A compartmented container is formed of a can having a single wall and opposite openable ends. The container includes a divider sealingly affixed diametrically across the interior of the container, thereby defining two separate volumes within the single can or container. The two volumes share the single divider wall in common. The divider wall is preferably formed of the same material, or of material compatible with, the material used to form the remainder of the container, or at least the ends of the container. The divider is preferably formed of a rigid material, and may include ribs or another form of stiffeners extending diametrically thereacross, in order to resist any differential pressures which may develop between the two volumes.

13 Claims, 3 Drawing Sheets

COMPARTMENTED CONTAINER

REFERENCE TO RELATED PATENT APPLICATION

This application is a continuation of international application PCT/US99/03569 filed Feb. 22, 1999, which designated the United States. This application also claims the benefit of U.S. Provisional Patent Application Serial No. 60/113,251 filed on Dec. 21, 1998.

BACKGROUND OF THE INVENTION

1. Field of the Invention

The present invention relates generally to containers of various types, and more specifically to a can type container having a divider therein for separating the contents of the can or container into two separate volumes. The present compartmented container provides for the separation of the contents of the container into two portions for consuming at different times, or for providing separate compartments for different foods, beverages, or other contents.

2. Description of the Related Art

The general concept of providing multiple quantities or servings of a food or other substance in a single package, with the package including multiple containers for the multiple quantities, is well known. These various means of providing multiple quantities in a single package range from the concept of the six pack for beverages, to other packaging for multiple containers each individually contained within a single larger package.

More recently, with the widespread use of cans for containing food, beverages, or other substances, the concept of joining two or more cans together in some way, has been developed. Generally, the various means used involves the construction of two separate cans, with their separate ends being joined in some manner, e.g., by a specialized crimp of one of the ends or lids against the other mating end of the other can. In other cases, a second can is placed within an outer can, to separate the contents of the two containers.

The various means of providing separate contents do not actually use a single can or container, but rather provide various means of joining two separate containers together. While such can construction is relatively simple, using existing (if slightly modified) crimping or other can assembly machinery, it requires considerably more material due to the duplication of can sides and ends, additional material required to allow for the crimp, etc.

Accordingly, what is needed is a means of dividing the contents of a single can or container into two separate volumes, rather than securing two (or more) separate cans or containers together to provide the two (or more) separate volumes. The present invention provides a divider, sealed across the interior of the can, for providing a separate volume on each side of the divider. The contents of the can are accessed by conventional means (can opener, pop tab, etc.) from each of the opposite ends of the can. The contents may be two separate servings or quantities of the same food or beverage, providing for consumption at different times, or may be different foods, beverage, or substances, e.g., a cola drink in one portion of the can, and an orange soda in the opposite portion, etc. While the divider may be sealed across the medial portion of the can to provide equal volumes, it will be seen that the divider may be installed closer to one end than to the other, to provide unequal volumes, if so desired. Various means of sealing the divider within the can or container are also provided.

A discussion of the related art of which the present inventor is aware, and its differences and distinctions from the present invention, is provided below.

U.S. Pat. No. 239,225 issued on Mar. 22, 1881 to Christian Clausen, titled "Package For Butter, Lard, &c.", describes two paired containers each having separate walls, bottoms, and lids. The two containers are placed face to face, with their two lids in contact with one another, and a retaining band is installed about their adjacent peripheries to hold the two containers together. The retaining band is cut and removed to separate the two containers for use. The Clausen assembly does not comprise a single can with a divider therein, as the two containers of the Clausen patent are separable from one another. The present invention comprises dividing the interior volume of a single can or container, and does not provide for separation of the single, contiguous wall of the container into separate components to form two separate containers.

U.S. Pat. No. 853,497 issued on May 14, 1907 to Edward W. Carnes, titled "Sectional Or Compartment Can," describes a pair of cans, with an upper can having a recessed bottom with a threaded circular wall, and a lower can having a raised top with a threaded circular wall for attaching to the bottom of the upper can. Thus, the two cans may be separated by unscrewing one from the other, with each can having a separate bottom, wall, and lid. As was noted above, this requires considerably more material than the present invention, and moreover does not retain the two containers together, as provided by the single can or container of the present invention, with its divider disposed therein.

U.S. Pat. No. 861,815 issued on Jul. 30, 1907 to Frank C. Cullen, titled "Compartment Can," describes a can having separable upper and lower portions, as in the other cans of the prior art discussed to this point. However, the Cullen can utilizes only a single common member serving as the floor for the upper can and the top for the lower can. The two cans are removably joined by a bayonet fitting between the two. As noted further above, the present invention differs in that the can structure comprises a single unit, with the divider permanently affixed therein to separate the interior of the single can into two separate volumes. The contents of the present compartmented container are accessed from the opposite ends of the single can, unlike the Cullen compartment can.

U.S. Pat. No. 2,553,559 issued on May 22, 1951 to George E. Eckman, titled "Compartment Container Assembly," describes a specially formed bead for joining two separate cans together at their facing ends. The top end of the lower can is recessed, and the bottom end of the upper can is reduced in diameter to seat within the recessed top of the lower can. The bead of the lower can is seated inwardly to grip the bottom bead of the upper can. As in the prior art discussed above, Eckman describes two separate cans which are mechanically fastened together, unlike the single, unitary can of the present invention with its diametric divider therein. The Eckman assembly also has in effect a double wall between the two cans, comprising the bottom of the upper can and separate top of the lower can, which is relatively wasteful of materials in comparison to the present single divider.

U.S. Pat. No. 2,652,148 issued on Sep. 15, 1953 to George T. Pfeifer, titled "Combination Package," describes a metal can type container having a separate plastic liner therein. In one embodiment of the Pfeifer patent (FIG. 7), two separate liners are installed in the can, with their adjacent bottom portions defining a central divider in the can. However, this structure is essentially a single outer container, with two inner containers installed therein to define the two separate volumes. The present invention does not provide separate inner liners, but rather utilizes only a divider baffle which extends diametrically across the can or container, thereby providing greater economy of materials than the arrangement of the Pfeiffer patent.

U.S. Pat. No. 2,963,194 issued on Dec. 6, 1960 to Thomas F. Brennan et al., titled "Multiple Container Package," describes a pair of cans of different diameters. Brennan et al. provide a retaining device which holds the base of the smaller can within the recessed lid of the larger can. The retaining collar is broken and removed to separate the two cans from one another. As has been noted further above, the present container has only a single wall with single opposite end components, with the interior volume of the container being divided into two separate areas by means of a single divider disposed therein. Brennan et al., as well as other assemblies discussed further above, utilize multiple wall containers, or multiple containers having some form of attachment means therebetween, unlike the present invention.

U.S. Pat. No. 5,279,841 issued on Jan. 18, 1994 to Chine-Min Yu, titled "Dual Container Connecting Ring And The Combination Thereof," describes a circumferentially frangible ring which is adhesively secured between the non-opening ends of two separate cans. When the cans are twisted relative to one another, the ring separates about the circumferential weakening means between the outer and inner portions, allowing the two cans to be separated from one another. As in the other devices discussed above, the Yu separable containers are relatively wasteful of materials, requiring to separate adjacent end portions along with the frangible ring. The present invention utilizes only a single can with a divider serving to separate the interior into two separate volumes, with the divider being common to both volumes.

British Patent Publication No. 692,439 published on Jun. 3, 1953 to Burnhouse Animal Products Ltd., titled "Improvements In Or Relating To Vacuum-Sealed Cans," describes the securing of the bases of two cans together, with the openable ends of the two cans being positioned at opposite ends of the assembly. The bases of the two cans are secured together by adhesive or solder. The Burnhouse Animal Products patent publication is particularly directed to stamped aluminum cans, having a continuous base and side wall formed as a unitary component with a separate top secured to the upper edge of the wall by a beaded seam. The present invention comprises a mirror image can, having two identical ends adapted for opening to access the contents of the two separate volumes therein.

Finally, British Patent Publication No. 946,802 published on Jan. 15, 1964 to the Metal Box Company, titled "Improvements In Or Relating To Portable Containers," describes a smaller diameter can seating in the recessed upper end of a larger diameter can. The two cans are removably connected by projections in the lid of the bottom can, which engage the seam of the adjacent end of the opposite can. The result is somewhat similar to the assembly of the Cullen '815 U.S. Patent, discussed further above. The Metal Box assembly provides two separate cans, unlike the present single can having a divider sealed internally across the diameter of the can to provide two separate volumes in a single can.

None of the above inventions and patents, either singly or in combination, is seen to describe the instant invention as claimed.

SUMMARY OF THE INVENTION

The present invention comprises a compartmented container, comprising a can or the like having a single wall and opposite openable ends. A divider is installed diametrically across the walls of the can and sealed thereacross, thereby defining two separate volumes within the single can, with the two volumes sharing the divider wall in common. The divider wall is preferably formed of a single rigid sheet of material, such as aluminum, tinned steel, etc., as appropriate for the type and grade of can or container with which it is assembled. The divider may be provided with reinforcing ribs or other reinforcing means to provide added stiffness in a relatively thin sheet of material, if desired, in order to resist the relative difference in pressure between the two volumes in a carbonated drink can when one of the volumes has been opened. The side wall of the can may be beaded in order to hold the divider in place therein, with conventional sealing means used to seal the opposite volumes from one another. The divider may be installed medially within the can, or may be installed closer to one end than the other to provide unequal volumes, if so desired.

Accordingly, it is a principal object of the invention to provide an improved compartmented container, with the container having a single wall and opposite openable ends, with a divider sealingly secured diametrically across the interior of the container to divide the container into two interior volumes and with each of the volumes sharing the divider as a common wall therebetween.

It is another object of the invention to provide an improved compartmented container, in which the divider comprises a rigid metal component.

It is a further object of the invention to provide an improved compartmented container, with the divider including stiffening means thereacross to resist differential pressures between the two volumes of the container.

An additional object of the invention is to provide an improved compartmented container, with the single wall of the container being circumferentially rolled or beaded to each side of the divider for mechanically securing the divider in place.

Still another object of the invention is to provide an improved compartmented container, with the divider being positionable medially within the container to divide the container into two essentially equal volumes, or positionable closer to one end of the container than the other to divide the container into unequal volumes.

Yet another object of the invention is to provide a compartmented container assembly adaptable to containers of various shapes.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
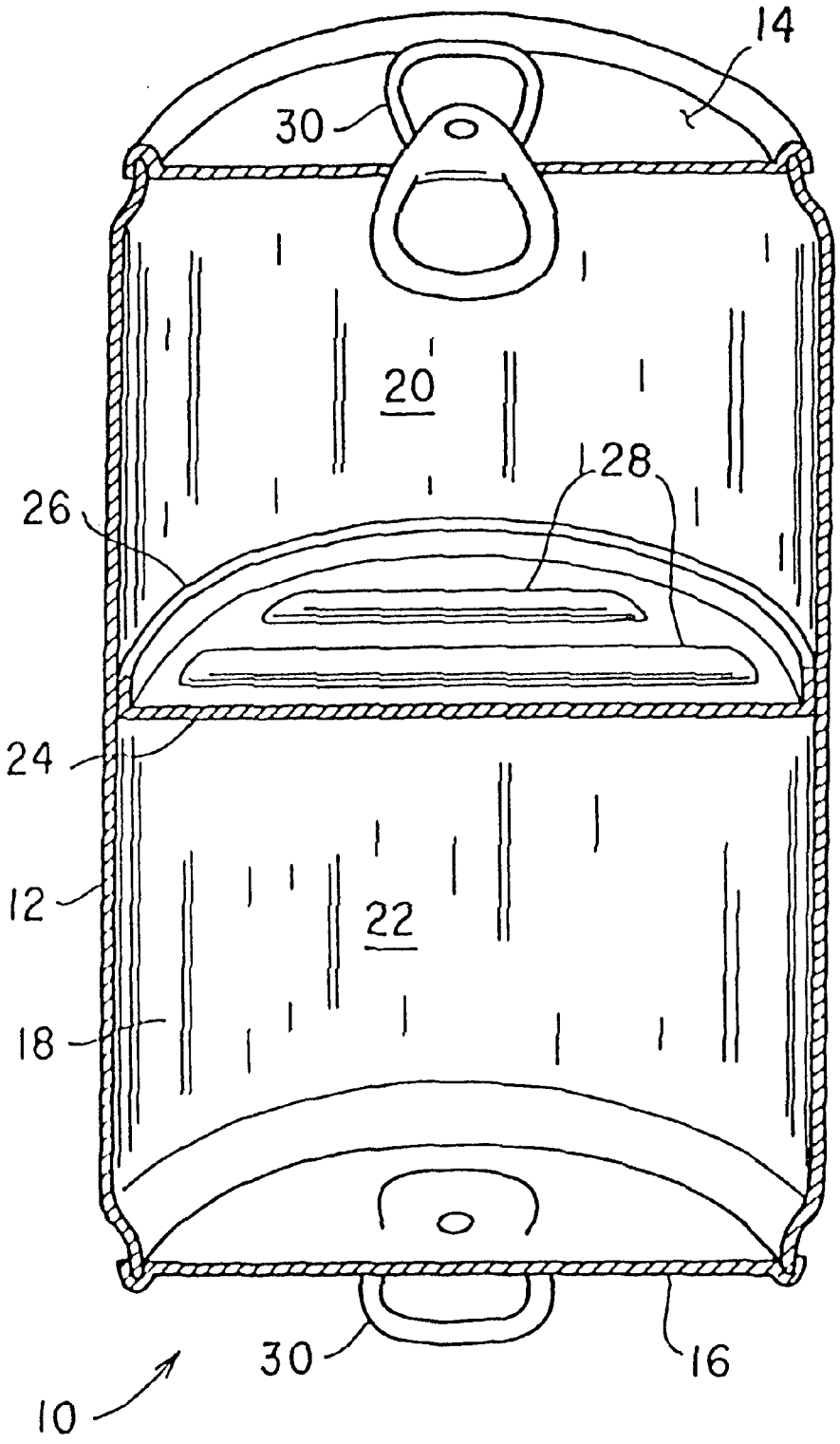
FIG. 1 is an elevation view in section of the present compartmented container, showing its internal structure.

The present invention comprises a compartmented container, with a first embodiment indicated by the reference numeral 10 in FIG. 1. The container or can 10 has a single, unitary wall 12 with a first end 14 and an opposite second end 16, in the manner of cans used for beverages and foods. The wall 12 may be formed as a continuous, unbroken cylinder, in the manner of pressed aluminum cans but having the second or lower end 14 configured for opening, or may be formed of a flat sheet of material which is rolled and joined with a seam along the side to form a cylindrical shape. The present invention may be applied to other, non-cylindrical container shapes as well, as described further below.

The wall 12 and two ends 14 and 16 of the can or container 10 define an interior 18, which is separated into two separate volumes, respectively 20 and 22, by a divider 24 which is sealingly affixed essentially diametrically across the interior 18 of the can 10. It will be seen that the first volume 20 is defined by one portion of the surrounding wall 12, the first can or container end 14, and the divider 24, with the second volume 22 being defined by the remaining portion of the surrounding wall 12, the second end 16, and the divider 24. Thus, the two volumes 20 and 22 share the divider 24 in common with one another. The divider 24 may be sealingly affixed within the interior 18 of the container or can 10 by means of a peripheral or circumferential flange 26, as required.

Other sealing means are described further below. The divider 24 may also include one or more stiffening flanges or ribs 28 extending thereacross, for precluding deformation of the divider 24 in the event of unequal pressures in the two volumes 20 and 22 when one of the volumes is opened to relieve any internal pressure to ambient while retaining the pressure in the opposite volume.

The container or can 10 of FIG. 1 is essentially symmetrical, with the two ends 14 and 16 being essentially identical to one another. The ends 14 and 16 may include some form of opening means for ease of access to the contents in each volume 20 and 22 of the container 10, such as the "pop tab" openers 30 shown in each can end 14 and 16 in FIG. 1. Other opening means may be provided, such as a lip or other means for using an opener to penetrate ends 14 and 16, a peripheral peel strip and key, etc.

Cans and containers to which the present invention may be applied, are typically formed of thin coated steel sheet or thin aluminum sheet stock. Typically, the materials used are consistent throughout a given can or container, but may be mixed (e.g., aluminum wall with one or both ends being formed of steel) if desired. Preferably, the separator or divider 24 of the present compartmented container 10 is formed of a sheet of the same material as the ends 14 and 16 of the container, although a different material may be used as desired.

Figure 2:
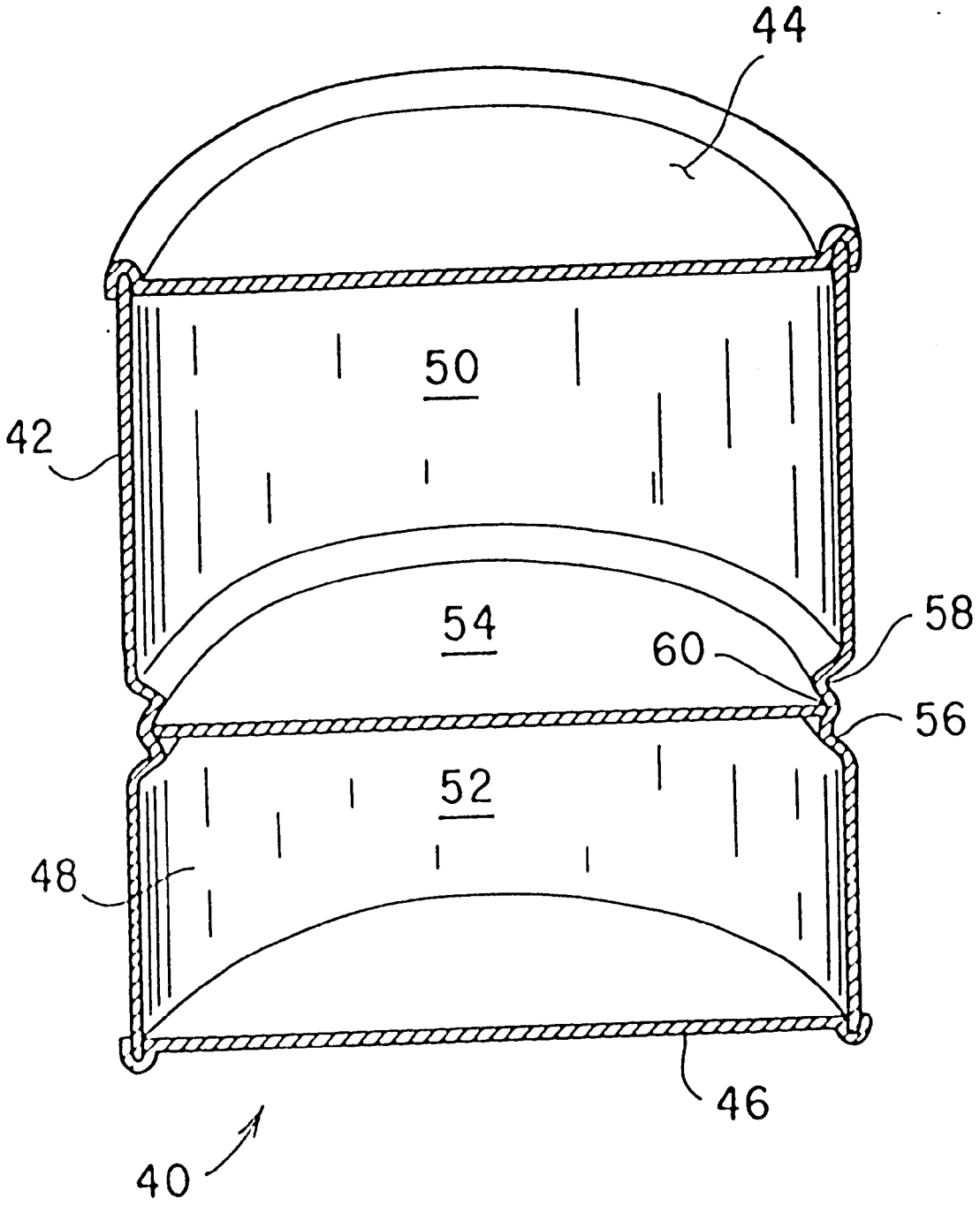
FIG. 2 is an elevation view in section of an alternative embodiment of the present compartmented container, showing a can having circumferential beading for securing the internal divider in place and the asymmetric placement of the divider within the can to provide unequal volumes.

The divider 24 of the container 10 of FIG. 1 is medially positioned within the interior 18 of the container, with the two volumes 20 and 22 being essentially equal to one another. However, it is not necessary that the divider be medially positioned within the container or can 10. FIG. 2 illustrates a container 40 in which the divider is positioned closer to one end than the other, resulting in unequal volumes within the container 40. The container 40 is generally configured like the container 10 of FIG. 1, with a single, unitary wall 42 and opposite ends 44 and 46 defining an interior 48. The interior 48 is divided into a first volume 50 and opposite second volume 52, by a divider 54. However, it will be seen that the divider 54 of the container 40 of FIG. 2, is positioned somewhat closer to the second end 46 of the container 40, than to the first end 44. This results in the second volume 52 being proportionately smaller than the first volume 50.

The means of securing the divider 54 within the container wall 42 of the container 40 of FIG. 2, is somewhat different than that used for the container 10 of FIG. 1. In FIG. 2, the container wall 42 is provided with an adjacent pair of inwardly formed beads, with a first bead 56 positioned immediately below the periphery of the divider 54, and a second bead 58 positioned immediately above the divider 54 periphery. These two inwardly formed beads 56 and 58 define an inwardly disposed groove 60 therebetween, for capturing the rim of the divider 54 therebetween to hold the divider 54 securely in the position desired within the interior space 48 of the can or container 40. The container 40 may be assembled by first forming one of the beads, e.g., the first bead 56, then installing the divider 54 to seat against the first bead 56, then forming the second bead 58 to the opposite side of the divider 54 to capture the divider 54 between the two beads 56 and 58. The two ends 44 and 46 may then be installed to complete the compartmented container 40 of FIG. 2.

Conventional sealing means as known in the art may be used to provide a liquid tight seal around the periphery of the divider 54, to seal the two volumes 50 and 52 from one another, as well as for sealing the volumes 20 and 22 from one another in the container or can 10 of FIG. 1. It will be seen that the container 40 of FIG. 2 may incorporate many of the same features provided in the compartmented container 10 of FIG. 1, such as stiffening ribs disposed across the divider 54, easy opening means for the two ends 44 and 46, etc., as desired.

Figure 3:
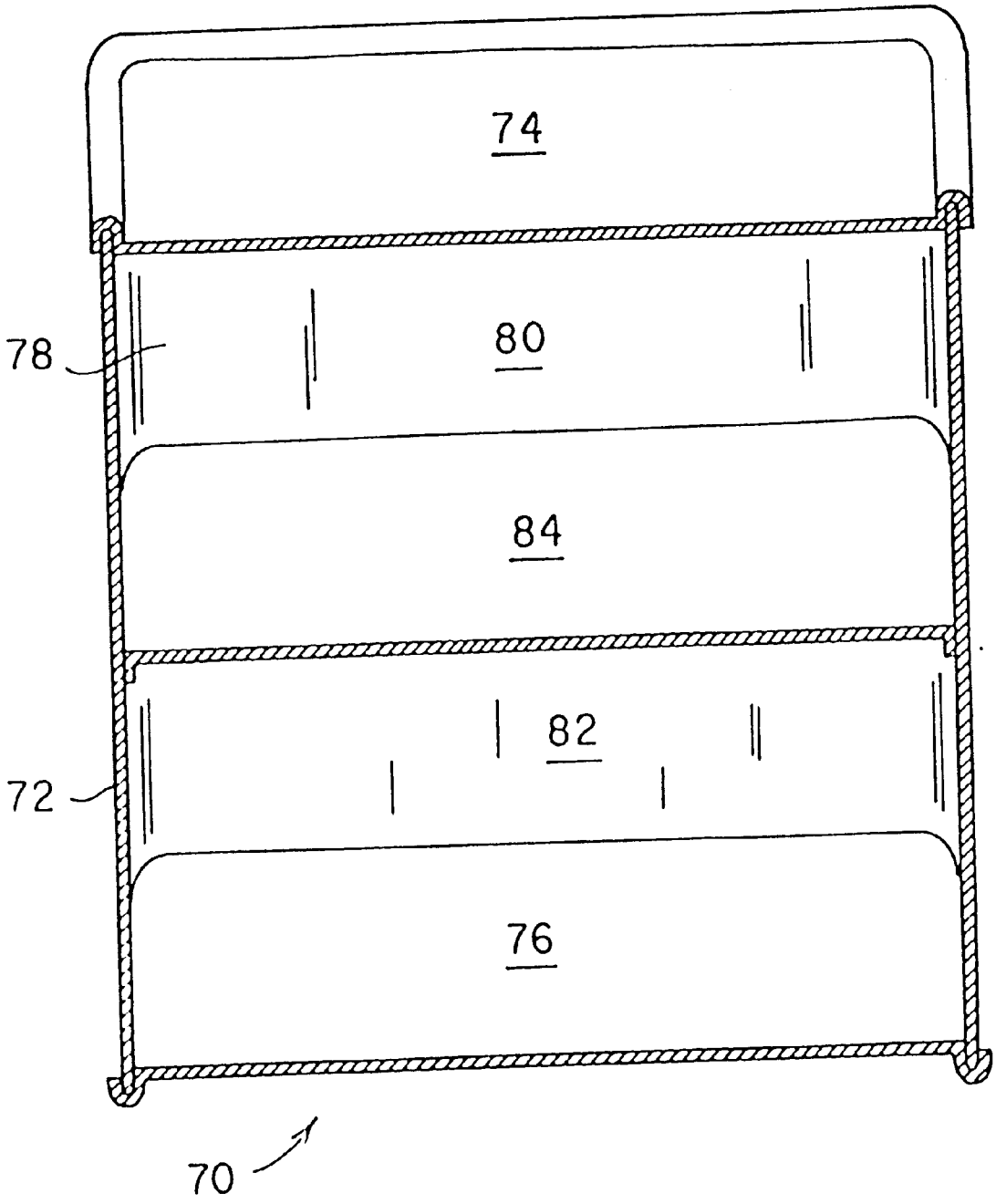
FIG. 3 is an elevation view in section of a further alternative embodiment, showing a divider installed within a can having other than a circular or round shape.

FIG. 3 provides a perspective view in section of yet another embodiment of the present compartmented container invention, showing a generally rectangular compartmented can or container 70. The container 70 includes an outer wall 72 and opposite ends 74 and 76, in the manner of the two cans or containers 10 and 40 discussed further above, with the wall 72 and ends 74 and 76 defining an interior 78. The interior 78 is separated into a first volume 80 and a separate second volume 82 by a divider 84, generally in the manner of the compartmented containers 10 and 40 respectively of FIGS. 1 and 2.

The generally rectangular can or container 70 of FIG. 3 is typical of those used to contain canned meats (e.g., Spam, tm), but which may be used for other purposes as well. It will be seen that the present compartmented container may be formed to have any practicable shape and size, and may be used to provide two separate quantities of virtually any practicable substances (foods, beverages, chemicals, etc.) as desired. Such rectangular containers 70 which are used for canned meats and the like are often provided with a tear strip or band formed in one end of the can, with a key being used to roll the tear strip about the periphery of the can for opening the can. Such opening means is conventional, and may be incorporated with both ends 74 and 76 of the can 70 of FIG. 3, and/or used as the opening means for any suitable can constructed or formed in accordance with the present compartmented container invention.

In summary, the present compartmented container provides an economically constructed means of storing two separate quantities of a product within a container having a single outer wall and two opposed ends, which construction has not been previously accomplished according to the prior art known to the present inventor. The container 10 of FIG. 1, with its easy opening means comprising "pop tabs" or the like, is particularly well suited for use as a drink container. Manufacturers of canned beverages, particularly soft drinks, recognize the fact that the container is often the most expensive part of the product. Accordingly, they prefer to provide the largest container reasonably possible, in order to contain the largest practicable volume of beverage, since the product is sold according to the amount of beverage, rather than according to the size of the container. Oftentimes, a person purchasing such a canned beverage, may not wish to consume the entire beverage at one time. The present compartmented container 10 enables such a consumer to consume a reasonable portion of the beverage initially from one portion of the container, while saving the remainder of the beverage in the opposite portion of the container, which remains sealed to preserve the freshness and carbonation of such a beverage. It is also possible to provide two different types or flavors of beverages in the two separate compartments of the same container according to the present invention, enabling two persons to drink a reasonable quantity of their favorite beverages without being required to purchase two relatively large cans separately.

While the present invention is particularly well adapted for containing separate quantities of food or beverage products, it will be seen that it is also well suited for containing various other products as well. As an example, certain products (two part epoxy resins, etc.) are required to be kept separate from one another until use, as mixing the two parts causes the mix to cure chemically. Generally, the amount of hardener used in such compounds is a relatively small volume of the total mix, and can be relatively difficult to mix accurately in the precisely proper quantity. The present compartmented container, particularly in accordance with the container 40 embodiment of FIG. 2, provides a relatively large first volume for containing one part of such a product, and a relatively small second volume for containing the relatively small quantity of hardener, reducer, etc., which may be required. It will be seen that many food products also lend themselves to such a container 40 with two differently sized volumes 50 and 52, as in the case of a larger volume containing a food, and a smaller volume containing a condiment for the food, which may be applied separately in the quantity desired by the consumer, rather than being mixed at the point of canning the product.

The present compartmented container is also well suited for containing two different types of foods in a single container. For example, two relatively small servings of a vegetable (e.g., corn and peas) may be provided in the same container, for serving at different times, or for providing different foods to two different people in the same household. The relatively small quantities provided in each volume of the container, are much better suited to individual servings and substantially avoid waste and leftovers often occurring in single person households due to the relatively large quantities generally found in conventional canned goods. Meats (e.g., canned ham and fish, etc.) may be provided in the two different compartments or volumes of a compartmented can according to the present invention, with the product of one compartment being used for one meal and the product of the second compartment remaining sealed and fresh for a subsequent meal, as desired.

Accordingly, the present compartmented can or container will provide a significant reduction in leftovers and wasted food, by providing only the quantity of food or other material desired or required at any given time. Thus, the present compartmented container will prove popular to consumers for containing all kinds of foods, beverages, and other commodities. The present compartmented containers will also prove popular with manufacturers and canners, due to the relatively inexpensive construction of the present containers, in comparison with the double sided and double ended cans and the like of the prior art. Accordingly, manufacturers and canners are likely to make advantageous use of the present invention, to respond to a long felt need for consumers.

It is to be understood that the present invention is not limited to the sole embodiment described above, but encompasses any and all embodiments within the scope of the following claims.

What is claimed is:

1. A compartmented container, comprising a can having a single unitary wall with a first end and an opposite second end;

wherein said first end and said second end each include opening means therein;

said can including an interior with a single divider sealingly affixed across said wall;

said divider defining a first volume and a second volume within said interior of said can, and each said volume sharing said single divider in common; and at least one stiffening rib formed across said divider to prevent deformation of said divider by resisting the relative difference in pressure when one of the volumes is opened.

2. The compartmented container according to claim 1, wherein said can is symmetrical and said first end and said second end are identical to one another.

3. The compartmented container according to claim 1, wherein said opening means of said first end and said second end comprise pop tabs.

4. The compartmented container according to claim 1, wherein said first end, said second end, and said divider of said can each comprise identical materials.

5. The compartmented container according to claim 1, wherein said wall of said can includes a first and a second circumferential bead adjacent to one another, for holding said divider therebetween.

6. The compartmented container according to claim 1, wherein said divider is medially disposed within said can, with said first volume and said second volume being equal to one another.

7. The compartmented container according to claim 1, wherein said divider is asymmetrically disposed within said can, with said first volume and said second volume being unequal to one another.

8. The compartmented container according to claim 1, wherein said can is generally cylindrical, with said first end, said second end, and said divider each being generally circular.

9. The compartmented container according to claim 1, wherein said can is non-cylindrical, with said first end, said second end, and said divider each being generally non-circular.

10. A compartmented container comprising:

a can having a single, unitary wall, with a first end, and an opposite second end, and an interior, wherein said first end and second end each include a pop tab for separately opening said can;

a divider including a single sheet of separator material, said divider being sealingly installed within the interior of said can and dividing the interior into a first and a second volume, with each volume sharing said single divider in common and a plurality of stiffening ribs formed across said divider to prevent deformation of said divider by resisting the relative difference in pressure when one of the volumes is opened.

11. The separator according to claim 10, wherein the first end and second end of the container and said divider each comprise identical materials.

12. The separator according to claim 10, wherein said divider is aluminum sheet material.

13. The separator according to claim 10, wherein said divider is steel sheet material.

* * * * *